US012722760B1

(12) United States Patent
Feldman

(10) Patent No.: US 12,722,760 B1
(45) Date of Patent: Sep. 1, 2026

(54) APPARATUS FOR PROPELLING A VESSEL THROUGH WATER BY FORWARD-FACING ROWING

(71) Applicant: Arkady Feldman, Stamford, CT (US)

(72) Inventor: Arkady Feldman, Stamford, CT (US)

( * ) Notice: Subject to any disclaimer, the term of this patent is extended or adjusted under 35 U.S.C. 154(b) by 0 days.

(21) Appl. No.: 19/399,074

(22) Filed: Nov. 24, 2025

(51) Int. Cl.

| | |
|---|---|
| ***B63H 16/04*** | (2006.01) |
| ***B63H 16/06*** | (2006.01) |
| ***B63H 16/067*** | (2006.01) |
| ***B63H 16/10*** | (2006.01) |

(52) U.S. Cl.
CPC ..... *B63H 16/04* (2013.01); *B63H 2016/063* (2013.01); *B63H 16/067* (2013.01); *B63H 16/10* (2013.01); *B63H 16/107* (2013.01)

(58) Field of Classification Search
CPC ..... B63H 16/04; B63H 16/10; B63H 16/067; B63H 16/107; B63H 2016/063
USPC ..... 440/101
See application file for complete search history.

(56) References Cited

U.S. PATENT DOCUMENTS

| | | | | |
|---|---|---|---|---|
| 2,569,245 A * | 9/1951 | Malcher | B63H 16/107 440/107 |
| 3,857,356 A | 12/1974 | Jewett | |
| 3,879,779 A * | 4/1975 | Jewett | B63H 16/04 114/343 |
| 4,052,951 A | 10/1977 | Farr | |
| 4,623,314 A | 11/1986 | Waugh | |
| 5,215,482 A | 6/1993 | Henry | |
| 5,647,782 A | 7/1997 | Henry | |
| 6,939,186 B1 | 9/2005 | Kuckes | |

FOREIGN PATENT DOCUMENTS

| | | | | |
|---|---|---|---|---|
| CN | 117682032 A | 3/2024 | | |
| DE | 20116742 U1 | 2/2002 | | |
| DE | 102005003854 A1 * | 8/2006 | | B63H 16/107 |
| EP | 4470903 A1 | 4/2024 | | |

OTHER PUBLICATIONS

DE-102005003854-A1 Translation Text (Year: 2006).*
Cunningham, Christopher, "Oars with Elbows a Forward-Facing Rowing System", Whitehall Tender, Small Boats Monthly, Mar. 2016, https://smallboatsmonthly.com/article/forward-facing-rowing-system/.
RowVista®, High-tech forward rowing system, 2024, https://www.coastalrowingforce.com/products/rowing-systems/rowvista.

* cited by examiner

*Primary Examiner* — Lars A Olson
*Assistant Examiner* — Eric Anthony Starck
(74) *Attorney, Agent, or Firm* — Gordon & Jacobson, P.C.

(57) ABSTRACT

An apparatus is provided for forward-facing rowing that propels a vessel, which includes a hull having port and starboard sides extending between a stern and bow. A middle line plane extends between the stern and bow. A platform is mounted to the hull above the port and starboard sides. A first pivot pin extends upward beyond the top side of the platform at a position offset laterally from the middle line plane. A first pivot arm pivots about the first pivot pin in a first plane disposed above the platform. A second pivot pin is operably disposed at a position offset laterally from the middle line plane. A second pivot arm pivots about the second pivot pin in a second plane disposed below the platform. First and second oar mounts are disposed on the ends of the first and second pivot arms.

25 Claims, 6 Drawing Sheets

APPARATUS FOR PROPELLING A VESSEL THROUGH WATER BY FORWARD-FACING ROWING

BACKGROUND

The present invention pertains to vessels propelled through water by forward-facing rowing.

Vessels that employ forward facing rowing have been developed. In such vessels, coordinated rowing action of the oars in water by the oarsman facing the bow of the hull propels the vessel forward in the water. The benefits of forward-facing rowing, including safer and more enjoyable rowing, are readily apparent. Patents that disclose various types of mechanisms for forward facing rowing include U.S. Pat. No. 5,215,482 issued to Henry; U.S. Pat. Nos. 4,943,250, 4,867,718, and 4,776,821, all issued to DuPont; U.S. Pat. No. 4,623,314 issued to Waugh; U.S. Pat. No. 4,382,830 issued to Cartwright; and DE Patent No. 20116742 to Kaltenbach.

FIG. 1 illustrates a prior art forward-facing rowing kayak 1, which includes a hull 2 having a bow 3 disposed opposite a stern 4. A port side 6 and a starboard side 5 extend between the bow 3 and the stern 4. A port-side oar mount 5*b* is secured to the port side 6 of the hull 2 and extends outward beyond the port side 6. A starboard-side oar mount 5*a* is secured to the starboard side 5 of the hull 2 and extends outward beyond the starboard side 5. A port-side oar assembly 7*b* is supported by the port-side oar mount 5*b*. A starboard-side oar assembly 7*a* is supported by the starboard-side oar mount 5*a*. The port-side oar mount 5*b* and the starboard-side oar mount 5*a* include respective gear mechanisms for forward facing rowing. An oarsman (not shown) is seated in the inside space of the hull 2 in a position between the oar mounts 5*a*, 5*b* and the stern 4 facing the bow 3. In this position, coordinated rowing action of the oar assemblies 7*a*, 7*b* in water by the oarsman facing the bow 3 propels the vessel 1 forward in the water.

The prior art forward-facing rowing apparatus have limitations, including inefficient rowing action due to the limited mechanical leverage provided by such apparatus.

A need thus exists for a forward facing rowing apparatus that does not have these limitations.

SUMMARY

The present disclosure describes an apparatus for propelling a vessel through water by forward-facing rowing.

The vessel includes a hull having a stern disposed opposite a bow, a port side and a starboard side extending between the stern and bow with a middle line place disposed midway between the port side and the starboard side and extending between the stern and the bow. The apparatus includes a platform configured to mount to the hull above the port side and starboard side of the hull. The platform includes a top side disposed opposite a bottom side. A first pivot pin extends from the top side of the platform upward beyond the top side of the platform. The first pivot pin is operably disposed at a position offset laterally from the middle line plane of the hull. A first pivot arm has a first end pivotably mounted to the first pivot pin and a second end disposed opposite the first end. The first pivot arm is configured to pivot about the first pivot pin in a first plane disposed above the platform. The apparatus further includes a second pivot pin operably disposed at a position offset laterally from the middle line plane of the hull. A second pivot arm has a first end pivotably mounted to the second pivot pin and a second end disposed opposite the first end. The second pivot arm is configured to extend across the middle line plane of the hull below the platform toward one of the starboard side and port side of the hull disposed opposite the second pivot pin. The second pivot arm is configured to pivot about the second pivot pin in a second plane disposed below the platform. A first oar mount is disposed on the second end of the first pivot arm, and a second oar mount is disposed on the second end of the second pivot arm.

In embodiments, the first plane of the first pivot arm can be offset vertically above the second plane of the second pivot arm.

In embodiments, the first pivot arm can be configured to extend across the middle line plane of the hull above the platform toward one of the port side and starboard side of the hull disposed opposite the first pivot pin. The second pivot arm can be configured to extend across the middle line plane of the hull below the platform toward one of the starboard side and port side of the hull disposed opposite the second pivot pin.

In one embodiment, the second pivot pin can be configured to extend from the bottom side of the platform downward beyond the bottom side of the platform.

In other embodiments, the second pivot pin can extend upward from either the port side or the starboard side of the hull, which is disposed opposite the first pivot pin.

In embodiments, lateral offset of first pivot pin relative to the middle line plane of the hull can correspond to (or match) lateral offset of the second pivot pin relative to the middle line plane of the hull.

In embodiments, the first and second pivot pins (and the pivot axes defined by the first and second pivot pins) can be configured in vertical orientations when the hull is at rest or in use in water, and the first and second planes of the pivoting movement of the first and second pivot arms can be configured in horizontal orientations when the hull is at rest or in use in water.

In embodiments, the first and second pivot arms can include annular bearings or annular bearing surfaces that receive the first and second pivot pins and support the pivoting movement of the first and second pivot arms.

In embodiments, the first oar mount can include a third pivot pin configured to support pivoting movement of a first oar, and the second oar mount can include a fourth pivot pin configured to support pivoting movement of a second oar.

In embodiments, the third and fourth pivot pins can be configured in horizontal orientations when the hull is at rest or in use in water.

In embodiments the first and second oars can include annular bearings or annular bearing surfaces that receive the corresponding third and second pivot pins and support the pivoting movement of the first and second oars.

In embodiments, the second end of the first pivot arm can extend beyond the hull with the first oar mount disposed outside the hull, and the second end of the second pivot arm can extend beyond the hull with the second oar mount disposed outside the hull.

In embodiments, the port side of the hull can be disposed opposite the first pivot pin, and the starboard side of the hull can be disposed opposite the second pivot pin. The second end of the first pivot arm can extend above and beyond the port side of the hull with the first oar mount outwardly spaced from the port side of the hull, and the second end of the second pivot arm can extend above and beyond the starboard side of the hull with the second oar mount outwardly spaced from the starboard side of the hull.

In other embodiments, the starboard side of the hull can be disposed opposite the first pivot pin, and the port side of the hull can be disposed opposite the second pivot pin. The second end of the first pivot arm can extend above and beyond the starboard side of the hull with the first oar mount outwardly spaced from the starboard side of the hull, and the second end of the second pivot arm can extend above and beyond the port side of the hull with the second oar mount outwardly spaced from the port side of the hull.

In embodiments, the middle line plane can be configured to logically partition the hull into two halves.

In embodiments, the hull can have a deck extending between the port side and the starboard side of the hull, and the platform can be disposed above the deck. The platform can be mounted to the deck.

In other embodiments, the platform can be mounted to the port side and the starboard side the hull.

In embodiments, at least one mount can be configured to mount the platform to the hull above the port side and starboard side of the hull. The platform and the at least one mount can define an opening. The second pivot arm can be configured to pass through the opening defined by the platform and the at least one mount.

In embodiments, pivoting movement of the first and second pivot arms can be driven by coordinated rowing action of the first and second oars in water by an oarsman facing the bow of the hull to propel the vessel forward in the water.

In embodiments, the vessel can be a kayak.

In other embodiments, the vessel can be a rowing shell.

In still other embodiments, the vessel can be a rowboat.

BRIEF DESCRIPTION OF THE DRAWINGS

These and other features of the present invention will be more fully appreciated when considered in the light of the following specification and drawings in which.

DETAILED DESCRIPTION OF THE PREFERRED EMBODIMENT(S)

The ensuing description provides preferred exemplary embodiment(s) only, and is not intended to limit the scope, applicability or configuration of the invention. Rather, the ensuing description of the preferred exemplary embodiment(s) will provide those skilled in the art with an enabling description for implementing a preferred exemplary embodiment of the invention, it being understood that various changes may be made in the function and arrangement of elements without departing from the scope of the invention.

Specific details are given in the following description to provide a thorough understanding of the embodiments. However, it will be understood by one of ordinary skill in the art that embodiments may be practiced without these specific details. For example, well-known circuits, processes, algorithms, structures, and techniques may be shown without unnecessary detail in order to avoid obscuring the embodiments.

In the description below, the term "platform" refers to a support structure that is mounted to the hull of a vessel in a position above both the port side and the starboard side of the hull. The support structure includes or supports at least one pivot pin and corresponding pivot arm that pivots about the pivot pin as described herein.

The present disclosure describes embodiments of an apparatus for propelling a vessel through water by forward-facing rowing.

Figure 1:
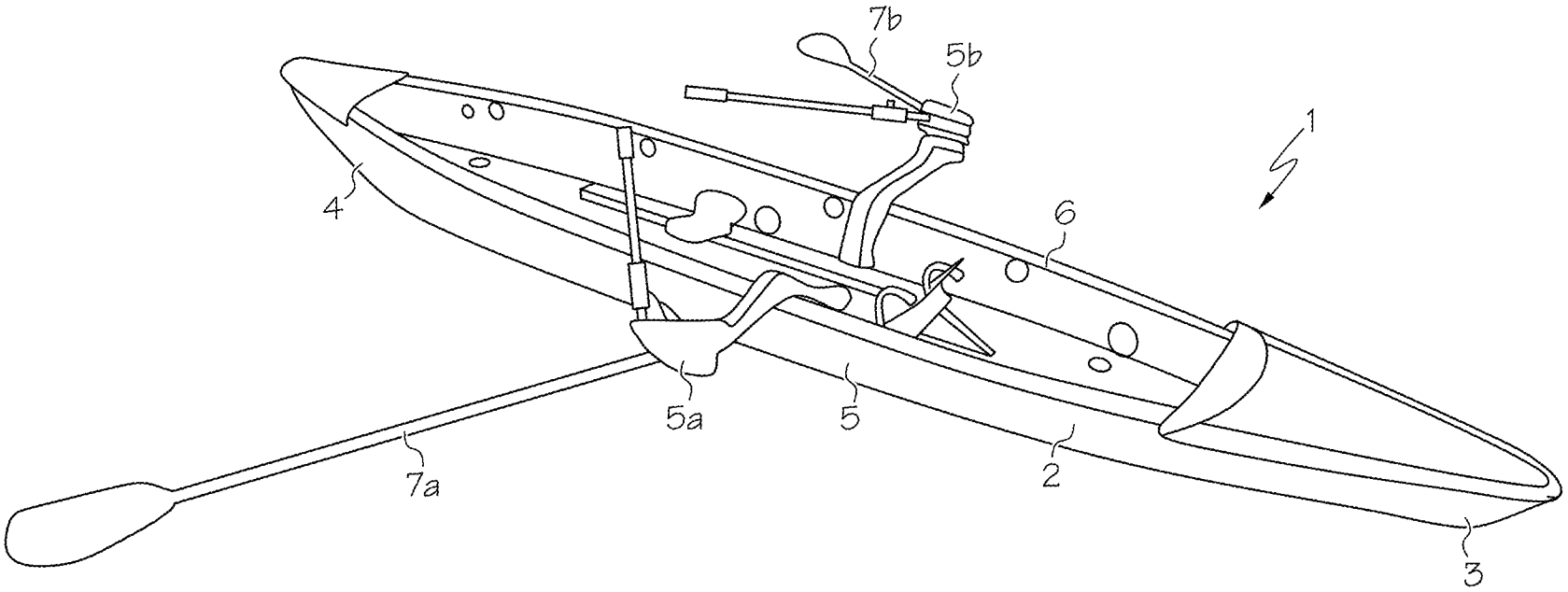
FIG. 1 (PRIOR ART)
FIG. 1 is an image of a prior art front-facing rowing kayak.
Figure 2:
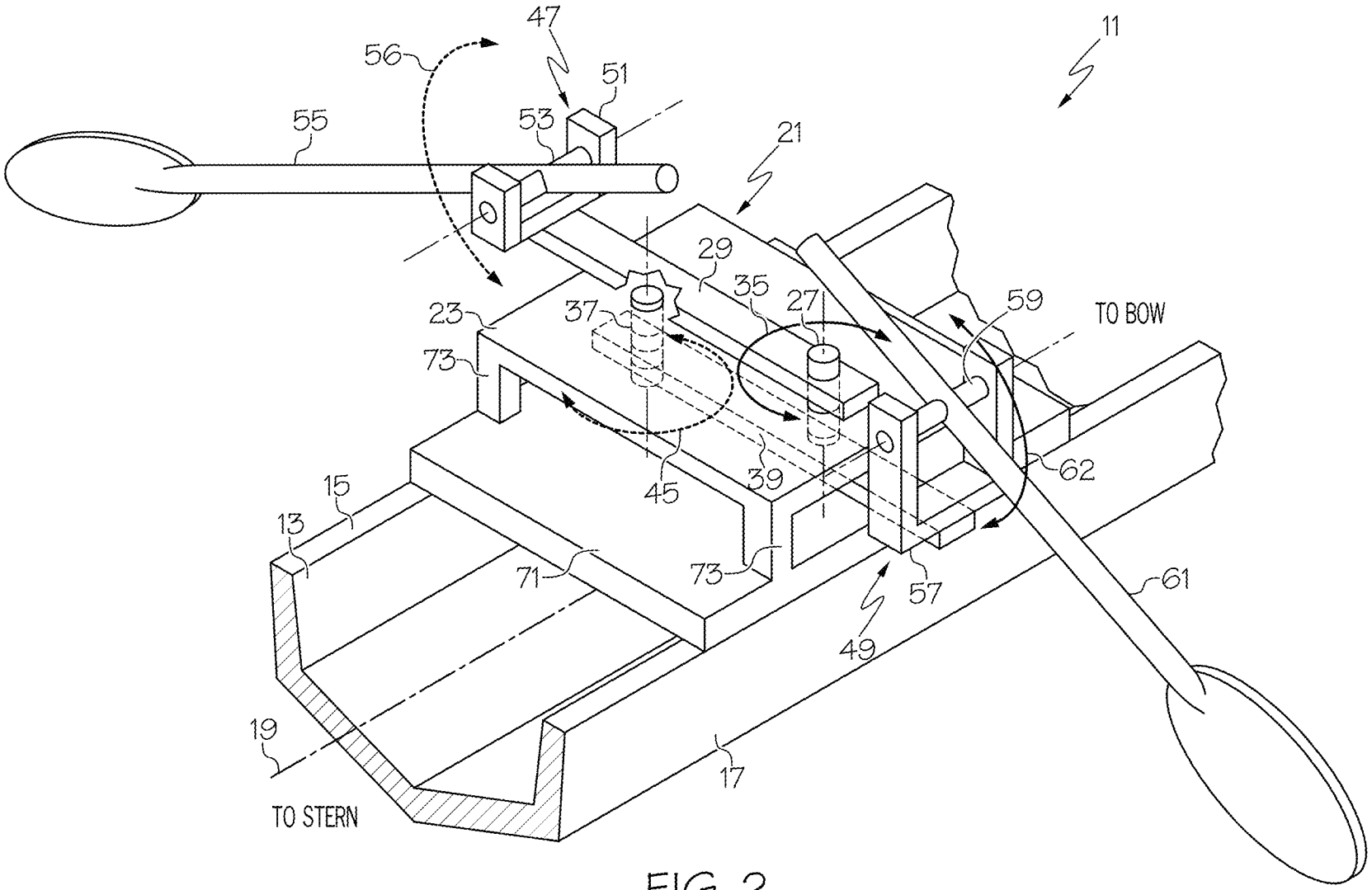
FIG. 2 is a schematic perspective view of a portion of a vessel equipped with an apparatus for forward facing rowing in accordance with a first embodiment of the present disclosure.
Figure 3:
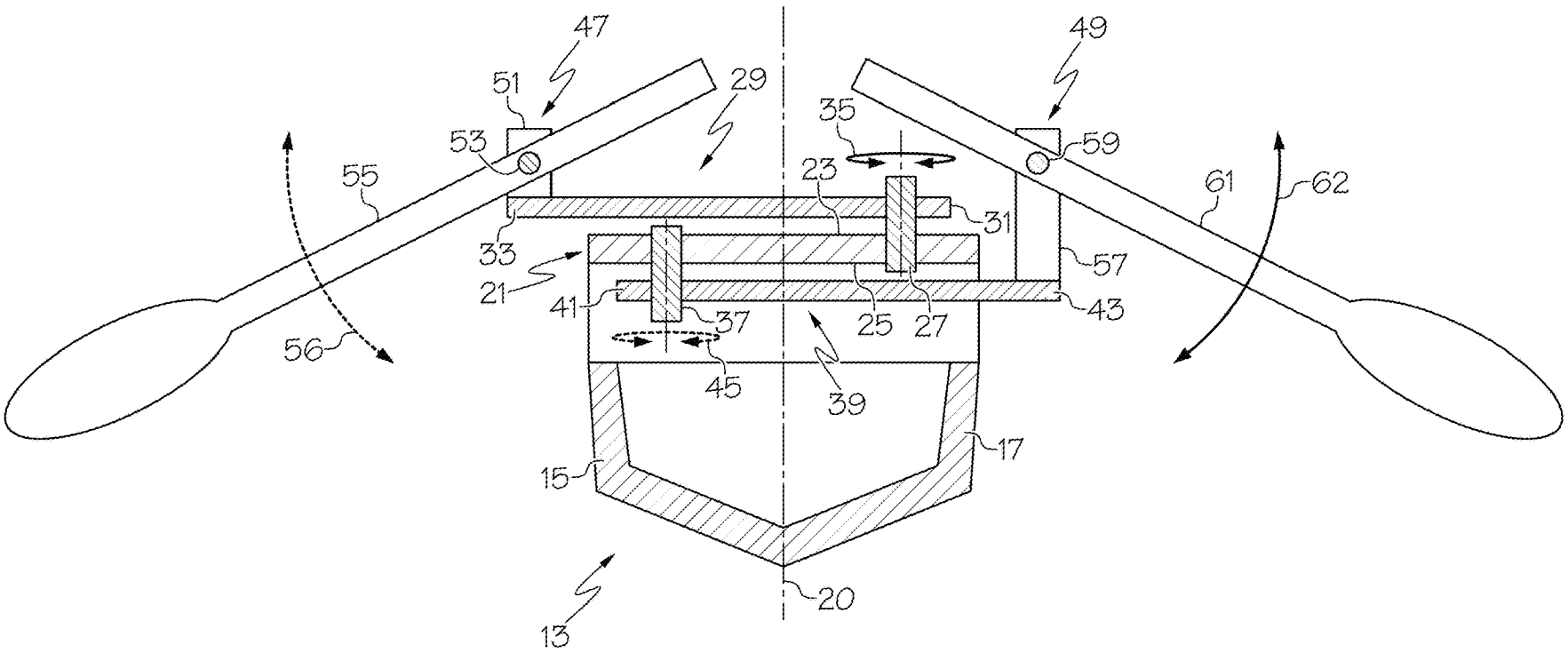
FIG. 3 is a schematic cross-sectional view of the vessel portion and apparatus for forward facing rowing of FIG. 2.

FIGS. 2 and 3 illustrate a first embodiment of the present disclosure that includes a vessel 11 (such as a kayak or rowing shell) with a hull 13 having a port (left) side 15 and a starboard (right) side 17 extending between a stern and a bow (not shown). A centerline 19 extends along the length of the hull 13 between the stern and the bow as shown in FIG. 2. A middle line plane 20 extends parallel to the centerline 19 midway between the port side 15 and a starboard side 17 of the hull 13 as shown in FIG. 3. The middle line plane 20 logically partitions the hull 13 into two halves. In embodiments, the middle line plane 20 can lie in a vertical orientation when the hull 13 is at rest or in use in water. The hull 13 can be constructed from plastic, metal, wood, composite material or other suitable material. A platform 21 is mounted to the hull 13 in a position above the port side 15 and the starboard side 17 of the hull 13. The platform 21 includes a top side 23 disposed opposite a bottom side 25 as shown in FIG. 3. In embodiments, the platform 21 can be formed from a generally flat piece of rigid material, such as metal, hard plastic, wood, composite material or other suitable material.

A first pivot pin 27 is molded with, or secured to or fixed to, the platform 21 and extends from the top side 23 of the platform 21 upward beyond the top side 23 of the platform 21 as shown. The first pivot pin 27 can be constructed from metal, plastic, or other suitable material. The first pivot pin 27 can be an integral component that is molded with the platform 21. Alternatively, the first pivot pin 27 can be a separate component that is fixed to the platform 21 by interference fit, screw thread interface, locking bolt or washer interface, or other suitable fastening mechanism. The first pivot pin 27 is operably disposed at a position offset laterally from the middle line plane 20 of the hull 13 as best shown in FIG. 3. A first pivot arm 29 has a first end 31 pivotably mounted to the first pivot pin 27 and a second end 33 disposed opposite the first end 31. The first pivot arm 29 is configured to extend across the middle line plane 20 of the hull 13 above the platform 21 toward the port side 15 of the hull 13 disposed opposite the first pivot pin 27. The first pivot arm 29 is configured to pivot (rotate) about the first pivot pin 27 in a first plane disposed above the platform 21 as indicated by arrow 35. The first pivot arm 29 can be constructed from a rigid material, such as metal, hard plastic, wood, composite material or other suitable material.

A second pivot pin 37 is molded with, or secured to or fixed to, the platform 21 and extends from the bottom side 25 of the platform 21 downward beyond the bottom side 25 of the platform 21. The second pivot pin 37 can be constructed from metal, plastic, or other suitable material. The second pivot pin 37 can be an integral component that is molded with the platform 21. Alternatively, the second pivot pin 37 can be a separate component that is fixed to the platform 21 by interference fit, screw thread interface, locking bolt or washer interface, or other suitable fastening mechanism. The second pivot pin 37 is operably disposed at a position offset laterally from the middle line plane 20 of the hull 13 as best shown in FIG. 3. A second pivot arm 39 has a first end 41 pivotably mounted to the second pivot pin 37 and a second end 43 disposed opposite the first end 41. The second pivot arm 39 is configured to extend below the platform 21 across the middle line plane 20 of the hull 13 toward the starboard side 17 of the hull 13 disposed opposite the second pivot pin 37. The second pivot arm 39 is configured to pivot (rotate) about the second pivot pin 37 in a second plane disposed below the platform 21 (opposite the first plane of the first pivot arm 29) as indicated by arrow 45. In embodiments, the first plane of the first pivot arm 29 can be stacked above, or offset vertically above, the second plane of the second pivot arm 39. The second pivot arm 39 can be constructed from a rigid material, such as metal, hard plastic, wood, composite material or other suitable material.

A first oar mount 47 is disposed on the second end 33 of the first pivot arm 29. One or more parts of the first oar mount 47 can be molded with, or secured to or fixed to, the second end 33 of the first pivot arm 29. A second oar mount 49 is disposed on the second end 43 of the second pivot arm 39. One or more parts of the second oar mount 49 can be molded with, or secured to or fixed to, the second end 43 of the second pivot arm 39.

In embodiments, the lateral offset (or distance) of the first pivot pin 27 relative to the middle line plane 20 of the hull 13 corresponds to (or matches) the lateral offset (or distance) of the second pivot pin 37 relative to the middle line plane 20 of the hull 13 as best shown in FIG. 3.

In embodiments, the first and second pivot pins 27, 37 (and the pivot axes defined by the first and second pins 27, 37) can be configured in vertical orientations when the hull 13 is at rest or in use in water as best shown in FIG. 3. Furthermore, the first and second planes of the pivoting movement of the first and second pivot arms 29, 39 can be configured in horizontal orientations when the hull is at rest or in use in water as best shown in FIG. 3.

In embodiments, the first and second pivot arms 29, 39 can include annular bearings or annular bearing surfaces that receive the first and second pivot pins 27, 37 and support the pivoting movement of the first and second pivot arms 29, 39.

In embodiments, the first oar mount 47 can include a u-shaped collar 51 that supports a third pivot pin 53. The u-shaped collar 51 and the third pivot pin 53 can be constructed from metal, plastic, or other suitable material. The u-shaped collar 51 can be molded with, or secured to or fixed to, the second end 33 of the first pivot arm 29. In embodiments, the u-shaped collar 51 can be secured to the first pivot arm 29 by bolts, screws, clamp, or other mechanical fastener. Alternatively, the u-shaped collar 51 can be integrally formed with the first pivot arm 29, for example, by metal casting or plastic molding methods. The third pivot pin 53 can be configured to extend through the shaft of a first oar 55 and support pivoting movement of the first oar 55 as indicated by arrow 56. In this configuration, the third pivot pin 53 can extend transversely through the intermediate portion of the oar 55 and permits the bottom portion of the oar 55 to pivot up/down (into and out of the water). In embodiments, the first oar mount 47 can be adapted to support feathering action of the first oar 55, which involves rotation of the first oar 55 abouts its central/longitudinal axis as is well known. The first oar 55 can be constructed from metal, plastic, or other suitable material. In embodiments, the third pivot pin 53 can be configured to be released and disengaged from the shaft of the first oar 55 to enable the first oar 55 to be detached from the first oar mount 47 for stowage and transport of the vessel.

In embodiments, the second oar mount 49 can include a u-shaped collar 57 that supports a fourth pivot pin 59. The u-shaped collar 57 and the fourth pivot pin 59 can be constructed from metal, plastic, or other suitable material. The u-shaped collar 57 can be molded with, or secured to or fixed to, the second end 43 of the second pivot arm 39. In embodiments, the u-shaped collar 57 can be secured to the second pivot arm 39 by bolts, screws, clamp, or other mechanical fastener. Alternatively, the u-shaped collar 57 can be integrally formed with the second pivot arm 39, for example, by metal casting or plastic molding methods. The fourth pivot pin 59 can be configured to extend through the shaft of a second oar 61 and support pivoting movement of the second oar 61 as indicated by arrow 62. In this configuration, the fourth pivot pin 59 can extend transversely through the intermediate portion of the oar 61 and permits the bottom portion of the oar 61 to pivot up/down (into and out of the water). In embodiments, the second oar mount 49 can be adapted to support feathering action of the second oar 61, which involves rotation of the second oar 61 abouts its central/longitudinal axis as is well known. The second oar 61 can be constructed from metal, plastic, or other suitable material. In embodiments, the fourth pivot pin 59 can be configured to be released and disengaged from the shaft of the second oar 61 to enable the second oar 61 to be detached from the second oar mount 49 for stowage and transport of the vessel.

In embodiments, the height (or vertical offset) of the pivot axis defined by the third pivot pin 53 relative to the top surface 23 of the platform 21 corresponds to (or matches) the height (or vertical offset) of the pivot axis defined by the fourth pivot pin 59 relative to the top surface 23 of the platform 21 as best shown in FIG. 3.

In embodiments, the third and fourth pivot pins 53, 59 (and the pivot axes defined by the third and fourth pivot pins 53, 59) can be configured in horizontal orientations when the hull 13 is at rest or in use in water as best shown in FIG. 3.

In embodiments, the shafts of the first and second oars 55, 61 can include annular bearings or annular bearing surfaces that receive the corresponding third and second pivot pins 53, 39 and support the pivoting movement of the first and second oars 55, 61.

Note that in the embodiment of FIGS. 2 and 3, the port side 15 of the hull 13 is disposed opposite the first pivot pin 27, and the starboard side 17 of the hull 13 is disposed opposite the second pivot pin 37. In this embodiment, the first pivot arm 29 can extend across the middle line plane 20 of the hull 13 above the platform 21 toward the port side 15 of the hull 13 disposed opposite the first pivot pin 27. The second end 33 of the first pivot arm 29 can extend beyond the hull 13 (particularly beyond the port side 15 of the hull 13) with the first oar mount 47 functioning as an outrigger disposed outside the hull 13 (particularly outside the port side 15 of the hull 13). The second pivot arm 39 can extend across the middle line plane 20 of the hull 13 below the platform 21 toward the starboard side 17 of the hull 13 disposed opposite the second pivot pin 37. The second end 43 of the second pivot arm 39 can extend beyond the hull 13 (particularly beyond the starboard side 17 of the hull 13)

with the second oar mount 49 functioning as an outrigger disposed outside the hull 13 (particularly outside the starboard side 17 of the hull 13).

In other embodiments, the starboard side 17 of the hull 13 can be disposed opposite the first pivot pin 27, and the port side 13 of the hull 13 can be disposed opposite the second pivot pin 27. In this case, the first pivot arm 29 can extend across the middle line plane 20 of the hull 13 above the platform 21 toward the starboard side 17 of the hull 13 disposed opposite the first pivot pin 27. The second end 33 of the first pivot arm 29 can extend beyond the hull 13 (particularly beyond the starboard side 17 of the hull 13) with the first oar mount 47 functioning as an outrigger disposed outside the hull 13 (particularly outside the starboard side 17 of the hull 13). The second pivot arm 39 can extend across the middle line plane 20 of the hull 13 below the platform 21 toward the port side 15 of the hull 13 disposed opposite the second pivot pin 37. The second end 43 of the second pivot arm 39 can extend beyond the hull 13 (particularly beyond the port side 15 of the hull 13) with the second oar mount 49 functioning as an outrigger disposed outside the hull 13 (particularly outside the port side 15 of the hull 13).

In the embodiment of FIGS. 2 and 3, the hull 13 has a top deck 71 that extends between the port side 15 and the starboard side 17 of the hull 13. The platform 21 can be disposed above the top deck 71 as best shown in FIG. 2.

Figure 4:
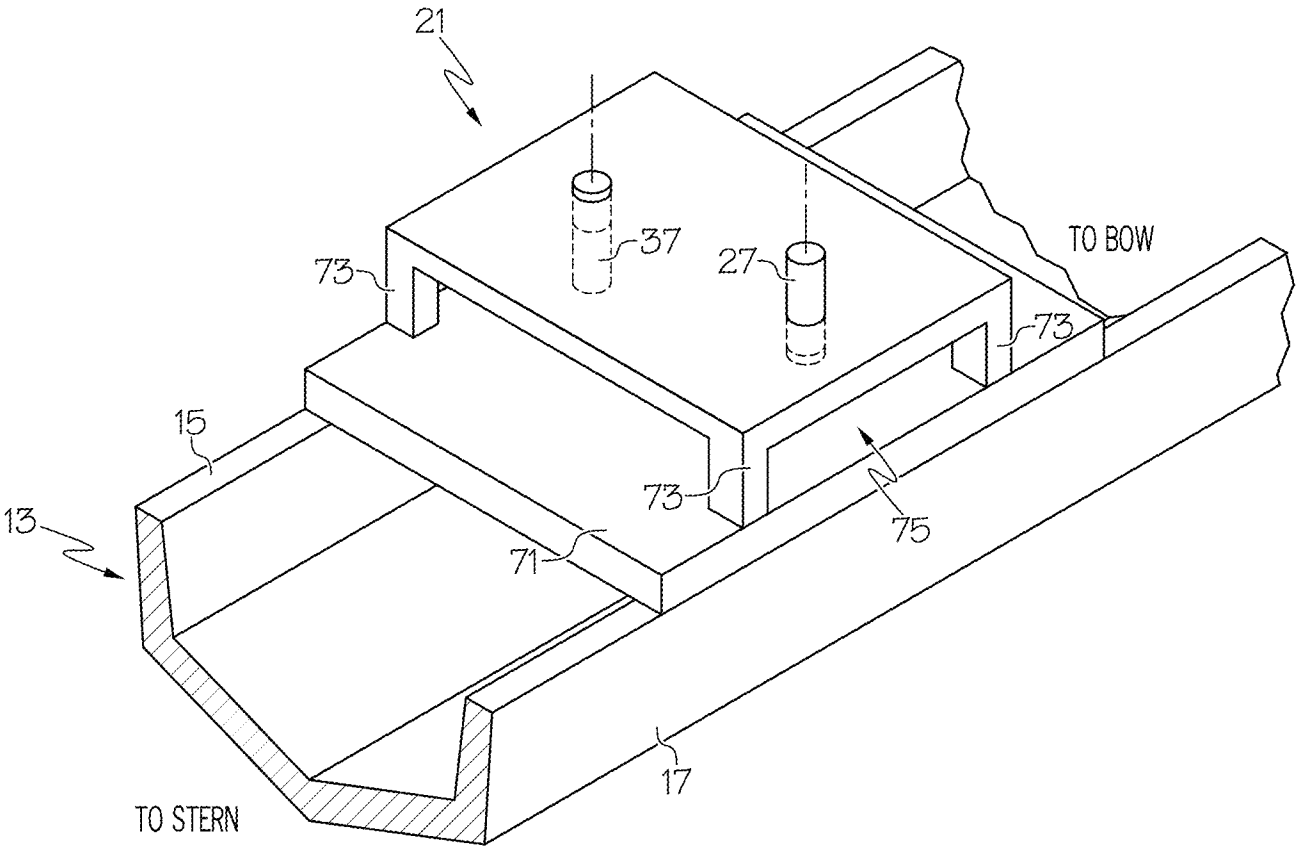
FIG. 4 is a schematic perspective view of the vessel portion and parts of the apparatus for forward facing rowing of FIGS. 2 and 3.

In embodiments, the platform 21 can be mounted to the top deck 71 in a position above the top deck 71 and above the port side 15 and starboard side 17 of the hull 13 by a plurality of mounts or posts 73. In embodiments, the platform 21 can be secured to the mount or posts 73 by bolts, screws, clamp or other mechanical fastener. Alternatively, the platform 21 can be integrally formed with the mount or posts 73, for example, by metal casting or plastic molding methods. In embodiments, the mounts or posts 73 can be secured to the top deck 71 by bolts, screws, clamp or other mechanical fasteners. In embodiments, the plurality of mounts or posts 73 can define an opening 75 as best shown in FIG. 4. The second pivot arm 39 (which extends below the platform 21) can be configured to pass through the opening 75 with the second end 43 of the second pivot arm 39 extending beyond the hull 13 as best shown in FIGS. 2 and 3.

Figure 5:
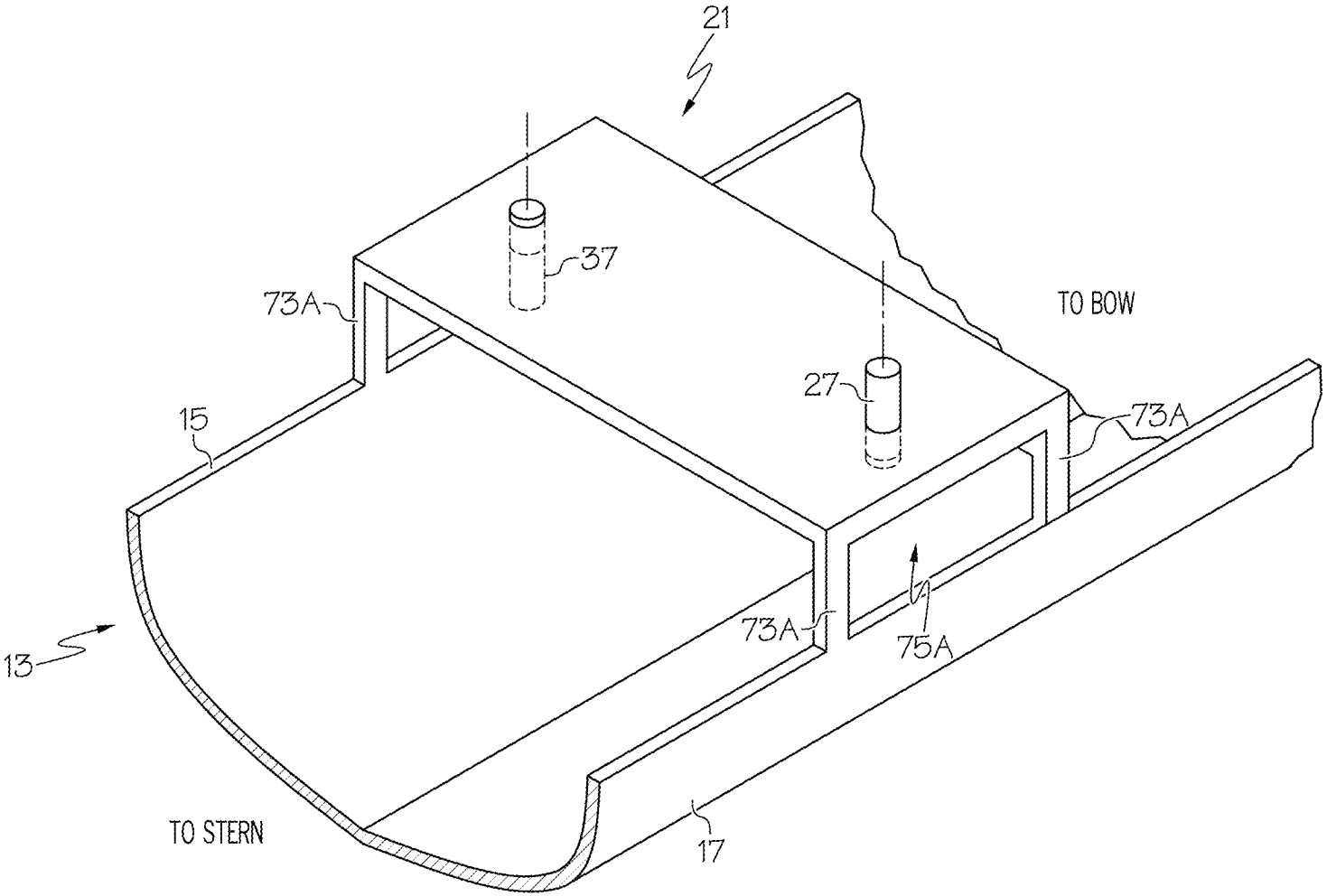
FIG. 5 is a schematic perspective view of a vessel portion and parts of an apparatus for forward facing rowing in accordance with a second embodiment of the present disclosure.

In a second embodiment shown in FIG. 5, the platform 21 can be mounted directly to the port side 15 and starboard side 17 of the hull 13 in a position above the port side 15 and starboard side 17 of the hull 13 by a plurality of mounts or posts 73A. In embodiments, the platform 21 can be secured to the mount or posts 73A by bolts, screws, clamp, or other mechanical fasteners. Alternatively, the platform 21 can be integrally formed with the mount or posts 73A, for example, by metal casting or plastic molding methods. In embodiments, the mounts or posts 73A can be secured to the port side 15 and starboard side 17 of the hull 13 by bolts, screws, clamp or other mechanical fastener. In embodiments, the plurality of mounts or posts 73A can define an opening 75A as best shown in FIG. 5. The second pivot arm 39 (which extends below the platform 21) can be configured to pass through the opening 75A with the second end 43 of the second pivot arm 39 extending beyond the hull 13 in a manner similar to that shown in FIGS. 2 and 3.

Figure 6:
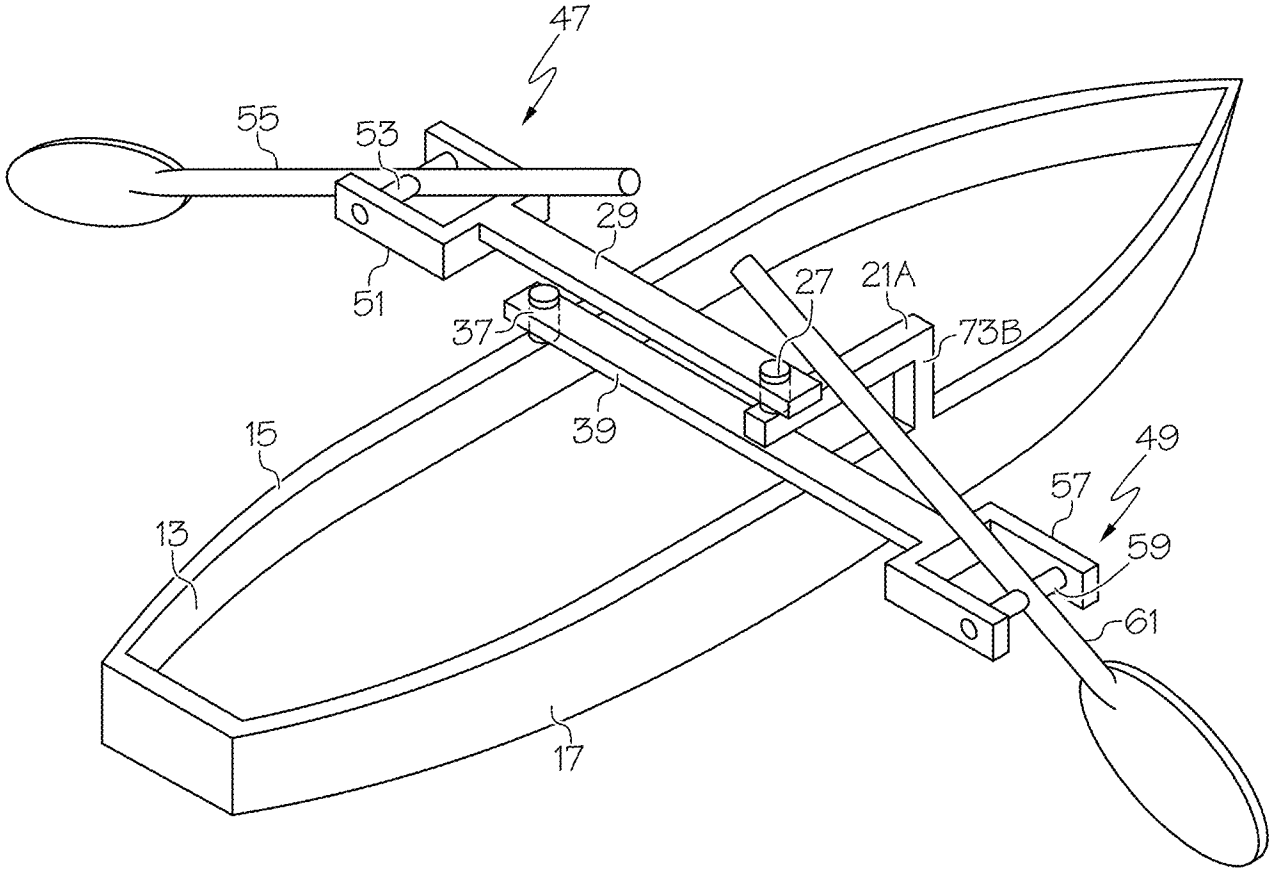
FIG. 6 is a schematic perspective view of a vessel equipped with an apparatus for forward facing rowing in accordance with a third embodiment of the present disclosure

In a third embodiment shown in FIG. 6, a platform 21A can be mounted to one side of the hull 13 (such as the starboard side 17 of the hull 13) in a position above the port side 15 and starboard side 17 of the hull 13 by a mount or post 73B. In embodiments, the platform 21A can be integrally formed with the mount or post 73B, for example, by metal machining, casting or plastic molding. Alternatively, the platform 21A can be secured or fixed to the mount or post 73B by bolts, screws, clamp, or other mechanical fastener. In embodiments, the mount or post 73B can be secured to the one side of the hull 13 (i.e., the starboard side 17) by bolts, screws, clamp or other mechanical fastener. In embodiments, the platform 21A can be configured to extend parallel to and above the one side of the hull 13 (such as the starboard side 17 of the hull 13) in a position above the port side 15 and starboard side 17 of the hull 13 with the mount or post 73B disposed forward of the first pivot pin 27 as shown in FIG. 6. The first pivot pin 27 is molded with, or secured to or fixed to, the platform 21A and extends from the top side of the platform 21A upward beyond the top side of the platform 21A as shown. The first pivot pin 27 can be constructed from metal, plastic, or other suitable material. The first pivot pin 27 can be an integral component that is molded with the platform 21A. Alternatively, the first pivot pin 27 can be a separate component that is secured or fixed to the platform 21A by interference fit, screw thread interface, locking bolt or washer interface, or other suitable fastening mechanism. The first pivot pin 27 is operably disposed at a position offset laterally from the middle line plane of the hull 13 as is evident from FIG. 6. A first pivot arm 29 has a first end pivotably mounted to the first pivot pin 27 and a second end disposed opposite the first end. The first pivot arm 29 is configured to extend across the middle line plane 20 of the hull 13 above the platform 21A toward the side of the hull 13 (i.e., the port side 13) disposed opposite the first pivot pin 27. The first pivot arm 29 is configured to pivot (rotate) about the first pivot pin 27 in a first plane disposed above the platform 21A similar to the first embodiment of FIGS. 2 and 3. The first pivot arm 29 can be constructed from a rigid material, such as metal, hard plastic, wood, composite material or other suitable material.

A second pivot pin 37 is molded with, or secured to or fixed to the side of the hull 13 opposite the first pivot pin 27 (i.e., the port side 13 of the hull as shown) and extends from that side of the hull upward beyond that side as shown in FIG. 6. The second pivot pin 37 can be constructed from metal, plastic, or other suitable material. The second pivot pin 37 can be an integral component that is molded with the hull 13. Alternatively, the second pivot pin 37 can be a separate component that is fixed to the hull 13 by interference fit, screw thread interface, locking bolt or washer interface, or other suitable fastening mechanism. The second pivot pin 37 is operably disposed at a position offset laterally from the middle line plane of the hull 13 as is evident from FIG. 6. A second pivot arm 39 has a first end pivotably mounted to the second pivot pin 37 and a second end disposed opposite the first end. The second pivot arm 39 can be configured to extend across the middle line plane of the hull 13 below the platform 21A toward the side (i.e., the starboard side 17) of the hull 13 disposed opposite the second pivot pin 37. The second pivot arm 39 is configured to pivot (rotate) about the second pivot pin 37 in a second plane disposed below the platform 21A (opposite the first plane of the first pivot arm 29). In embodiments, the first plane of the first pivot arm 29 can be stacked above, or offset vertically above, the second plane of the second pivot arm 39. The second pivot arm 39 can be constructed from a rigid material, such as metal, hard plastic, wood, composite material or other suitable material.

A first oar mount 47 is disposed on the second end of the first pivot arm 29, and a second oar mount 49 is disposed on the second end of the second pivot arm 39 as described above with respect to the first embodiment of FIGS. 2 to 4. One or more parts of the first oar mount 47 can be molded with, or secured to or fixed to, the second end of the first pivot arm 29. One or more parts of the second oar mount 49 can be molded with, or secured to or fixed to, the second end 43 of the second pivot arm 39.

In embodiments, the lateral offset (or distance) of the first pivot pin 27 relative to the middle line plane of the hull 13 corresponds to (or matches) the lateral offset (or distance) of the second pivot pin 37 relative to the middle line plane of the hull 13 as described above with respect to the first embodiment of FIGS. 2 to 4.

In embodiments, the first and second pivot pins 27, 37 (and the pivot axes defined by the first and second pins 27, 37) can be configured in vertical orientations when the hull 13 is at rest or in use in water as described above with respect to the first embodiment of FIGS. 2 to 4.

In embodiments, the first and second pivot arms 29, 39 can include annular bearings or annular bearing surfaces that receive the first and second pivot pins 27, 37 and support the pivoting movement of the first and second pivot arms 29, 39 as described above with respect to the first embodiment of FIGS. 2 to 4.

In embodiments, the height (or vertical offset) of the pivot axis defined by the third pivot pin 53 of the first oar mount 47 relative to the top surface of the platform 21A corresponds to (or matches) the height (or vertical offset) of the pivot axis defined by the fourth pivot pin 59 of the second oar mount 49 relative to the top surface of the platform 21A.

Note that in the embodiment of FIG. 6, the port side 15 of the hull 13 is disposed opposite the first pivot pin 27, and the starboard side 17 of the hull 13 is disposed opposite the second pivot pin 37. In this embodiment, the first pivot arm 29 can extend across the middle line plane of the hull 13 above the platform 21A toward the port side 15 of the hull 13 disposed opposite the first pivot pin 27. The second end of the first pivot arm 29 can extend beyond the hull 13 (particularly beyond the port side 15 of the hull 13) with the first oar mount 47 functioning as an outrigger disposed outside the hull 13 (particularly outside the port side 15 of the hull 13). The second pivot pin 27 extends from the port side 15 of the hull 13 upward beyond the port side 15 as shown in FIG. 6. The second pivot arm 39 can extend from the second pivot pin 27 across the middle line plane of the hull 13 below the platform 21A toward the starboard side 17 of the hull 13 disposed opposite the second pivot pin 37. The opposite second end of the second pivot arm 39 can extend beyond the hull 13 (particularly beyond the starboard side 17 of the hull 13) with the second oar mount 49 functioning as an outrigger disposed outside the hull 13 (particularly outside the starboard side 17 of the hull 13).

In other embodiments (not shown), the starboard side 17 of the hull 13 can be disposed opposite the first pivot pin 27, and the port side 13 of the hull 13 can be disposed opposite the second pivot pin 27. In this case, the first pivot arm 29 cam extend across the middle line plane of the hull 13 above the platform 21A toward the starboard side 17 of the hull 13 disposed opposite the first pivot pin 27. The second end of the first pivot arm 29 can extend beyond the hull 13 (particularly beyond the starboard side 17 of the hull 13) with the first oar mount 47 functioning as an outrigger disposed outside the hull 13 (particularly outside the starboard side 17 of the hull 13). The second pivot pin 27 extends from the starboard side 17 of the hull 13 upward beyond the starboard side 17. The second pivot arm 39 can extend from the second pivot pin 27 across the middle line plane of the hull 13 below the platform 21A toward the port side 15 of the hull 13 disposed opposite the second pivot pin 37. The opposite second end of the second pivot arm 39 can extend beyond the hull 13 (particularly beyond the port side 15 of the hull 13) with the second oar mount 49 functioning as an outrigger disposed outside the hull 13 (particularly outside the port side 15 of the hull 13).

In embodiments, the platform 21A and mount or post 73B can define an opening. The second pivot arm 39 (which can extend below the platform 21A) can be configured to pass through this opening with second end of the second pivot arm 39 extending beyond the hull 13 as shown in FIG. 6.

In embodiments, the hull 13 of the vessel as described herein can further include a seat for the oarsman disposed within the hull 13 (or on the top deck of the hull 13) in a position between the platform 21 and the stern of the hull 13. The seat can be disposed in a fixed position within the hull 13 (for a kayak) or configured to slide relative to the hull 13 (for a rowing shell). The hull 13 can further include foot supports for the oarsman at a position between the platform 21 and the bow of the hull 13.

In embodiments, the pivoting movement of the first and second pivot arms 29, 39 can be driven by coordinated rowing action of the first and second oars 55, 61 in water by an oarsman facing the bow of the hull 13 to propel the vessel forward in the water in a direction within eyesight of the oarsman. Specifically, the oarsman can grip the upper portions of the two oars 55, 61 above the respective oar mounts 47, 49 and place the bottom portions of the two oars 55, 61 in the water and impart rowing action that involves backward strokes of the oars 55, 61 with the bottom portions of the oars 55, 61 in the water and forward strokes of the oars 55, 61 with the bottom portions of the oars 55, 61 preferably out of the water. The backward strokes of the oars 55, 61 imparts pivoting movement of the first and second pivot arms 29, 39, which propels the vessel in a forward direction within eyesight of the oarsman.

In embodiments, the vessel can be a kayak. In other embodiments, the vessel can be rowing shell. In still other embodiments, the vessel can be a rowboat.

Note that in the embodiments described herein, the first and second pivot arms are configured to extend from one side of the hull and across the middle line plane of the hull to the opposed platform-mounted pivot pins. This configuration allows the length of the first and second pivot arms 29, 39 to be extended, which increases the mechanical leverage provided by the forward facing rowing apparatus. Such increase in leverage can enhance the efficiency of the rowing action imparted by the oarsman, making it easier for the oarsman to propel the vessel forward by the forward facing rowing action. Furthermore, because pivoting movement of the pivot arms lie in planes that are stacked vertically, one above another, the pivot arms can be mounted to opposite sides of the vessel, increasing the radius of the oar's swing and therefore increasing efficiency of rowing and speed.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the spirit and scope of the invention.

I claim:

1. An apparatus for propelling a vessel through water by forward-facing rowing, wherein the vessel comprises a hull having a stern disposed opposite a bow, a port side and a starboard side extending between the stern and bow with a middle line plane disposed midway between the port side and starboard side and extending between the stern and the bow, the apparatus comprising:

a platform mounted to the hull above the port side and starboard side of the hull, wherein the platform includes a top side disposed opposite a bottom side;

a first pivot pin that extends from the top side of the platform upward beyond the top side of the platform, wherein the first pivot pin is operably disposed at a position offset laterally from the middle line plane of the hull;

a first pivot arm having a first end pivotably mounted to the first pivot pin and a second end disposed opposite the first end, wherein the first pivot arm is configured to pivot about the first pivot pin in a first plane disposed above the platform;

a second pivot pin operably disposed at a position offset laterally from the middle line plane of the hull;

a second pivot arm having a first end pivotably mounted to the second pivot pin and a second end disposed opposite the first end, wherein the second pivot arm is configured to pivot about the second pivot pin in a second plane disposed below the platform;

a first oar mount disposed on the second end of the first pivot arm; and a second oar mount disposed on the second end of the second pivot arm.

2. An apparatus according to claim 1, wherein:

the first plane of the first pivot arm is offset vertically above the second plane of the second pivot arm.

3. An apparatus according to claim 1, wherein:

the first pivot arm is configured to extend across the middle line plane of the hull above the platform toward one of the port side and starboard side of the hull disposed opposite the first pivot pin; and the second pivot arm is configured to extend across the middle line plane of the hull below the platform toward one of the starboard side and port side of the hull disposed opposite the second pivot pin.

4. An apparatus according to claim 1, wherein:

the second pivot pin is configured to extend from the bottom side of the platform downward beyond the bottom side of the platform.

5. An apparatus according to claim 1, wherein:

the second pivot pin is configured to extend upward from either the port side or the starboard side of the hull, which is disposed opposite the first pivot pin.

6. An apparatus according to claim 1, wherein:

lateral offset of first pivot pin relative to the middle line plane of the hull corresponds to lateral offset of the second pivot pin relative to the middle line plane of the hull.

7. An apparatus according to claim 1, wherein:

the first and second pivot pins are configured in vertical orientations when the hull is at rest or in use in water, and the first and second planes of the pivoting movement of the first and second pivot arms are configured in horizontal orientations when the hull is at rest or in use in water.

8. An apparatus according to claim 1, wherein:

the first and second pivot arms include annular bearings or annular bearing surfaces that receive the first and second pivot pins and support the pivoting movement of the first and second pivot arms.

9. An apparatus according to claim 1, wherein:

the first oar mount includes a third pivot pin configured to support pivoting movement of a first oar; and the second oar mount includes a fourth pivot pin configured to support pivoting movement of a second oar.

10. An apparatus according to claim 9, wherein:

the third and fourth pivot pins are configured in horizontal orientations when the hull is at rest or in use in water.

11. An apparatus according to claim 9, wherein:

the first and second oars include annular bearings or annular bearing surfaces that receive the corresponding third and fourth pivot pins and support the pivoting movement of the first and second oars.

12. An apparatus according to claim 1, wherein:

the second end of the first pivot arm extends beyond the hull with the first oar mount disposed outside the hull; and the second end of the second pivot arm extends beyond the hull with the second oar mount disposed outside the hull.

13. An apparatus according to claim 1, wherein:

the port side of the hull is disposed opposite the first pivot pin, and the starboard side of the hull is disposed opposite the second pivot pin; and the second end of the first pivot arm extends above and beyond the port side of the hull with the first oar mount outwardly spaced from the port side of the hull, and the second end of the second pivot arm extends above and beyond the starboard side of the hull with the second oar mount outwardly spaced from the starboard side of the hull.

14. An apparatus according to claim 1, wherein:

the starboard side of the hull is disposed opposite the first pivot pin, and the port side of the hull is disposed opposite the second pivot pin; and the second end of the first pivot arm extends above and beyond the starboard side of the hull with the first oar mount outwardly spaced from the starboard side of the hull, and the second end of the second pivot arm extends above and beyond the port side of the hull with the second oar mount outwardly spaced from the port side of the hull.

15. An apparatus according to claim 1, wherein:

the middle line plane logically partitions the hull into two halves.

16. An apparatus according to claim 1, wherein:

the hull has a deck extending between the port side and the starboard side of the hull; and the platform is disposed above the deck.

17. An apparatus according to claim 16, wherein:

the platform is mounted to the deck.

18. An apparatus according to claim 1, wherein:

the platform is mounted to both the port side and the starboard side the hull.

19. An apparatus according to claim 1, further comprising:

at least one mount configured to mount the platform to the hull above the port side and starboard side of the hull, wherein the platform and the at least one mount defines an opening, wherein the second pivot arm is configured to pass through the opening defined by the platform and the at least one mount.

20. An apparatus according to claim 1, wherein:

pivoting movement of the first and second pivot arms is driven by coordinated rowing action of the first and second oars in water by an oarsman facing the bow of the hull to propel the vessel forward in the water.

21. An apparatus according to claim 1, wherein:

the hull further comprises a seat for the oarsman disposed in a position between the platform and the stern of the hull.

22. An apparatus according to claim 1, wherein:

the vessel comprises a kayak.

23. An apparatus according to claim 1, wherein:

the vessel comprises a rowing shell.

24. An apparatus according to claim 1, wherein:

the vessel comprises a rowboat.

25. A vessel propelled through water by forward-facing rowing, the vessel comprising:

a hull having a stern disposed opposite a bow, a port side and a starboard side extending between the stern and bow with a middle line plane disposed midway between the port side and starboard side and extending between the stern and the bow;

a platform mounted to the hull above the port side and starboard side of the hull, wherein the platform includes a top side disposed opposite a bottom side;

a first pivot pin that extends from the top side of the platform upward beyond the top side of the platform, wherein the first pivot pin is operably disposed at a position offset laterally from the middle line plane of the hull;

a first pivot arm having a first end pivotably mounted to the first pivot pin and a second end disposed opposite the first end, wherein the first pivot arm is configured to pivot about the first pivot pin in a first plane disposed above the platform;

a second pivot pin operably disposed at a position offset laterally from the middle line plane of the hull;

a second pivot arm having a first end pivotably mounted to the second pivot pin and a second end disposed opposite the first end, wherein the second pivot arm is configured to pivot about the second pivot pin in a second plane disposed below the platform;

a first oar mount disposed on the second end of the first pivot arm; and a second oar mount disposed on the second end of the second pivot arm.

* * * * *